US010743093B2

(12) United States Patent
Nakatsukasa

(10) Patent No.: US 10,743,093 B2
(45) Date of Patent: Aug. 11, 2020

(54) GRILLE AND ACOUSTIC DEVICE

(71) Applicant: YAMAHA CORPORATION, Hamamatsu-shi (JP)

(72) Inventor: Hitoshi Nakatsukasa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/900,943

(22) Filed: Feb. 21, 2018

(65) Prior Publication Data

US 2018/0176670 A1 Jun. 21, 2018

Related U.S. Application Data

(63) Continuation of application No. PCT/JP2016/073502, filed on Aug. 9, 2016.

(30) Foreign Application Priority Data

Aug. 24, 2015 (JP) ..... 2015-164698

(51) Int. Cl.
*H04R 1/02* (2006.01)
*H04R 1/40* (2006.01)

(52) U.S. Cl.
CPC ..... *H04R 1/023* (2013.01); *H04R 1/02* (2013.01); *H04R 1/025* (2013.01); *H04R 1/406* (2013.01)

(58) Field of Classification Search
None
See application file for complete search history.

(56) References Cited

U.S. PATENT DOCUMENTS 5,754,669 A 5/1998 Shiota et al.
5,825,903 A 10/1998 Shiota et al.
2005/0271220 A1* 12/2005 Bathurst ..... H04M 3/56 381/92

(Continued)

FOREIGN PATENT DOCUMENTS

EP 0777402 A2 6/1997
JP H09215076 A 8/1997
JP 2009248640 A 10/2009

OTHER PUBLICATIONS

International Search Report issued in Intl. Appln. No. PCT/JP2016/073502 dated Oct. 25, 2016. English translation provided.

(Continued)

*Primary Examiner* — Kenny H Truong
(74) *Attorney, Agent, or Firm* — Rossi, Kimms & McDowell LLP

(57) ABSTRACT

A grille and an acoustic device having a superior exterior design without impairment of acoustic efficiency are provided. The grille includes: a through hole-provided region having a plurality of through holes; and a non-through hole-provided region having a plurality of non-through holes each with a bottom, and provided adjacent to the through hole-provided region. The through holes and the non-through holes entirely provide a plurality of openings on an exterior surface of the grille. In the non-through hole-provided region, a depth of the non-through holes on a side close to the through hole-provided region is greater than a depth of the non-through holes on a side distant from the through hole-provided region.

9 Claims, 6 Drawing Sheets

(56) References Cited

U.S. PATENT DOCUMENTS

| | | | | |
|---|---|---|---|---|
| 2013/0001971 | A1 | 1/2013 | Stein | |
| 2015/0289037 | A1* | 10/2015 | Kutil | H04R 1/403<br>381/387 |

OTHER PUBLICATIONS

Written Opinion issued in Intl. Appln. No. PCT/JP2016/073502 dated Oct. 25, 2016.
Office Action issued in Chinese Appln. No. 201680048884.5 dated Jan. 17, 2019. English translation provided.
Notification of the Decision of Rejection issued in Chinese Appln. No. 201680048884.5 dated Nov. 7, 2019. English translation provided.
Office Action issued in Japanese Appln. No. 2015-164698 dated Aug. 6, 2019. English translation provided.
Office Action issued in Chinese Appln. No. 201680048884.5 dated Jul. 25, 2019. English translation provided.

* cited by examiner

GRILLE AND ACOUSTIC DEVICE

TECHNICAL FIELD

The present invention relates to a grille which is to be provided on a front face, etc. of an acoustic device equipped with a speaker and/or a microphone or of air-conditioning furniture, and an acoustic device including the grille.

BACKGROUND ART

Common acoustic devices equipped with a speaker and/or a microphone are provided with a grille that covers a front face, etc. of the speaker and/or the microphone in order to protect a speaker diaphragm, etc. and to prevent the entry of dust, etc. The grille has a plurality of through holes that allow the passage of sound. In such a case, when the region having the through holes is surrounded by a smooth surface having no through holes, the through hole-provided region looks as if it floats over the smooth surface. Therefore, in order not to degrade the exterior design of the device, non-through holes each provided with a bottom and having the same diameter as that of each through hole are formed around the through hole-provided region.

For example, a speaker grille disclosed in Patent Document 1 has a plurality of recessed parts (non-through holes) each provided with a bottom and having the same diameter as that of each hole part (through hole) on a design surface. Patent Document 1 also describes that the recessed parts each with a bottom are provided so as to coincide with a reinforcement rib on a back face of the speaker grille, without a decrease in the strength of the grille and without impairment of the appearance of the design surface in which a plurality of hole parts are provided as if they are continuous.

PRIOR ART DOCUMENTS

Patent Documents

Patent Document 1: Japanese Unexamined Patent Application, Publication No. 2009-248640

SUMMARY OF THE INVENTION

Problems to be Solved by the Invention

The through holes allow external light to pass therethrough without reflecting it while the non-through holes reflect external light at the bottom. Therefore, the boundary between the region where the through holes are formed and the region where the non-through holes are formed is likely to be visually recognized due to the difference in brightness between the through holes and the non-through holes.

To avoid this, the diameter of the through holes is made smaller than that of the non-through holes so as to make the boundary between the regions less noticeable. However, in such a case, the reduction in the diameter of the through holes may result in decreased efficiency and/or degraded characteristics of a speaker.

The present invention was made in view of such circumstances and has an objective of providing a grille and an acoustic device having a superior exterior design without impairment of acoustic efficiency.

Means for Solving the Problems

According to an aspect of the present invention, a grille comprises: a through hole-provided region having a plurality of through holes; and a non-through hole-provided region having a plurality of non-through holes each with a bottom, and provided adjacent to the through hole-provided region, wherein the through holes and the non-through holes entirely provide a plurality of openings on an exterior surface of the grille, and wherein, in the non-through hole-provided region, a depth of the non-through holes on a side close to the through hole-provided region is greater than a depth of the non-through holes on a side distant from the through hole-provided region.

According to another aspect of the present invention, an acoustic device comprises the grille.

DESCRIPTION OF EMBODIMENTS

Figure 1:
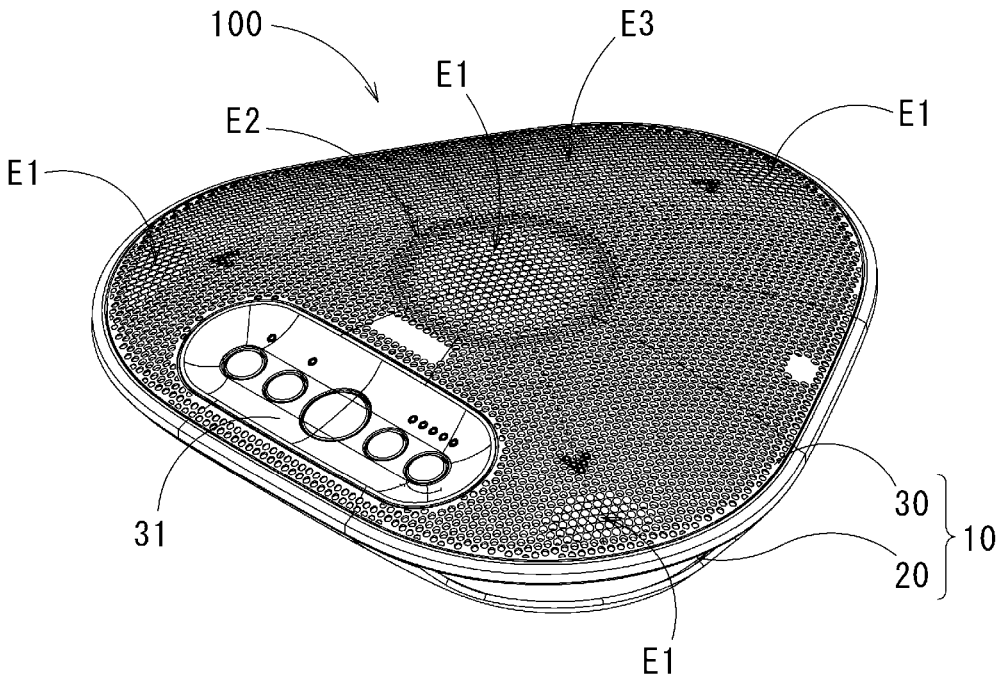
FIG. 1 is a perspective view of an acoustic device with a grille according to an embodiment of the present invention.

According to an aspect of the present invention, a grille comprises: a through hole-provided region having a plurality of through holes; and a non-through hole-provided region having a plurality of non-through holes each with a bottom, and provided adjacent to the through hole-provided region, wherein the through holes and the non-through holes entirely provide a plurality of openings on an exterior surface of the grille, and wherein, in the non-through hole-provided region, a depth of the non-through holes on a side close to the through hole-provided region is greater than a depth of the non-through holes on a side distant from the through hole-provided region.

As the depth of the non-through holes increases, external light is more likely to fail to reach deep into the non-through holes. Thus, when the non-through holes are deeper, the intensity of the external light reflected by the bottom is lowered, and in turn the brightness thereof can be lowered. Therefore, in the present invention, the non-through holes having different depths are provided, i.e., the non-through holes close to the through hole-provided region are deeper and the non-through holes distant from the through hole-provided region are shallower, whereby the brightness in the non-through holes close to the through hole-provided region is set to be lower than the brightness in the non-through holes distant from the through hole-provided region. Accordingly, the difference in brightness between the through holes and the non-through holes which is visually recognized on the exterior surface of the grille is reduced, whereby the boundary between the through hole-provided region and the non-through hole-provided region is blurred to provide a superior exterior design. In other words, the brightness in the non-through holes located close to the through hole-provided region can be made closer to the brightness in the through holes by making the non-through holes located on the side adjacent to the through hole-provided region deeper than the non-through holes located on the side distant from the through hole-provided region, whereby the boundary between the through hole-provided region and the non-through hole-provided region is blurred, and a superior exterior design is provided accordingly.

Furthermore, the non-through hole-provided region having the non-through holes each with a bottom is provided adjacent to the through hole-provided region, thereby enabling the strength of the grille to be further improved, as compared to the case in which the through holes are provided over the entire region.

In the grille of the aspect of the present invention, it is preferred that a plurality of rows of the non-through holes in the non-through hole-provided region are provided from a side adjacent to the through hole-provided region toward a side distant from the through hole-provided region. Furthermore, it is also preferred that the rows are provided in such a manner that the depth of the non-through holes gradually decreases from the side adjacent to the through hole-provided region toward the side distant therefrom.

The intensity of external light reflected by the bottoms of the non-through holes decreases with increasing depth of the non-through holes, resulting in a gradual decrease in brightness. Therefore, in the non-through hole-provided region that adjoins the through hole-provided region, the depth of the non-through holes gradually decreases from the side adjacent to the through hole-provided region toward the side of the non-through hole-provided region distant from the through hole-provided region, whereby the brightness gradation is formed in such a manner that the brightness gradually increases with increasing distance from the through hole-provided region. Consequently, the effect of blurring the boundary between the through hole-provided region and the non-through hole-provided region is enhanced, thereby enabling the exterior design to be improved.

In the grille of the aspect of the present invention, the non-through hole-provided region preferably surrounds the through hole-provided region.

The boundary between the through hole-provided region and the non-through hole-provided region of the grille is blurred, whereby the aperture of the unit of the speaker, the microphone, or the like is made appear larger than it really is.

In the grille of the aspect of the present invention, the bottoms of the non-through holes are preferably formed as irregular-reflection surfaces.

When the bottoms of the non-through holes are irregular-reflection surfaces, the intensity of external light that has been reflected by the bottoms of the non-through holes and has escaped to the outside can be further lowered. Therefore, even when the grille is thin and the depths of the non-through holes are small, the difference in brightness between the through holes and the non-through holes is reduced due to the irregular-reflection surfaces provided at the bottom. Furthermore, the brightness in each of the non-through holes can be adjusted more precisely by changing the shape of the bottom of the non-through hole in accordance with the parameter of the depth of the non-through hole, thereby enabling the design to be further improved. The irregular-reflection surfaces may be, for example, embossed surfaces, small R-surfaces, or cone-shaped surfaces.

In the grille of the aspect of the present invention, an exterior design region is preferably provided adjacent to the non-through hole-provided region on the exterior surface.

In the grille of the aspect of the present invention, in the exterior design region, a plurality of non-through holes having the same depth as that of the non-through holes may be provided in the non-through hole-provided region on the side close to the exterior design region, thereby creating a sense of uniformity in design and in turn providing a superior design.

The exterior design region having a plurality of the non-through holes is provided adjacent to the non-through hole-provided region, and the non-through hole-provided region connects between the through hole-provided region and the exterior design region. Therefore, the openings are formed on the entire exterior surface, and the openings enable a consistent exterior design to be provided. Moreover, the difference in brightness between the through hole-provided region and the exterior design region can be blurred by the non-through hole-provided region connecting therebetween, whereby a superior exterior design with a sense of uniformity in which the brightness varies continuously from the through hole-provided region toward the exterior design region is provided.

According to another aspect of the present invention, an acoustic device comprises the grille.

It is to be noted that the term "exterior surface" as referred to herein means a face provided on a viewer side. Also, the term "irregular-reflection surface" as referred to herein means a face that gives irregular reflections of light.

According to the present invention, the formation of the grille having through holes formed in a desired region is enabled. Furthermore, by applying the grille to an acoustic device, etc., the present invention is capable of providing an acoustic device having a superior exterior design with a blurred boundary between the through hole-provided region and the non-through hole-provided region without impairment of acoustic efficiency. Moreover, the grille according to the present invention allows air to move through the through holes and thus may be included in an intake and exhaust device.

Hereinafter, an embodiment in which the present invention is applied to an acoustic device will be described with reference to the drawings.

Figure 2A:
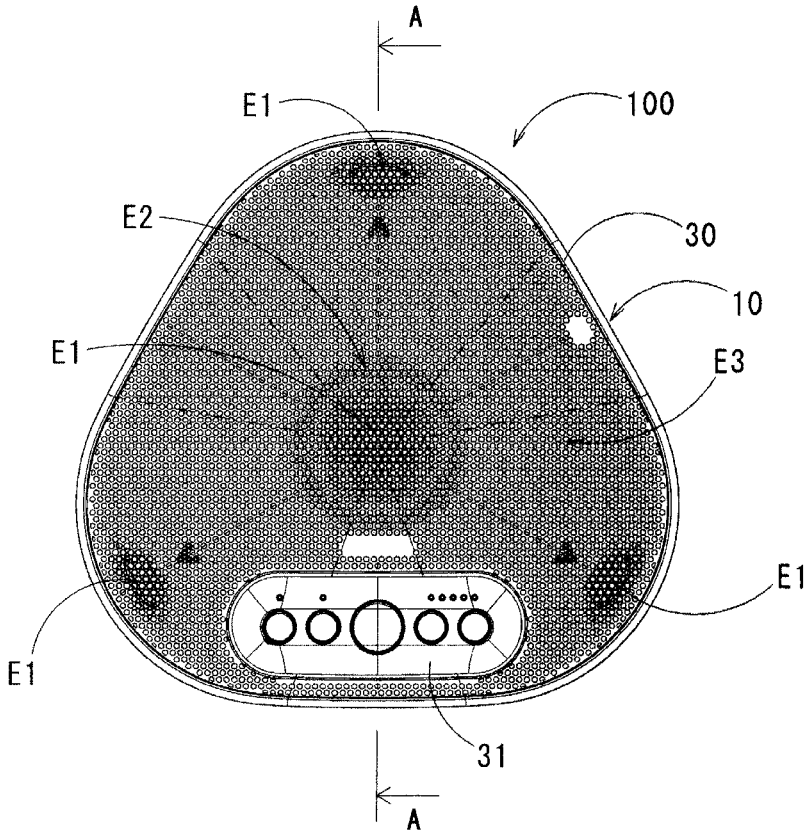
FIG. 2A is a plan view of the acoustic device of FIG. 1.
Figure 2B:
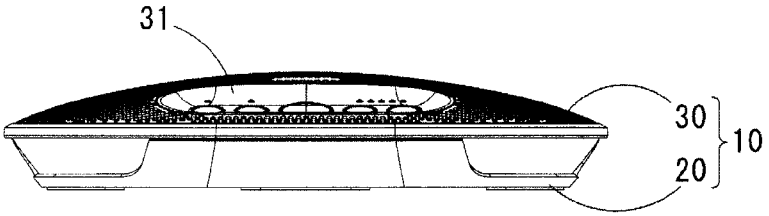
FIG. 2B is a side view of the acoustic device of FIG. 1.

FIGS. 1, 2A and 2B each illustrate an acoustic device 100 according to an embodiment of the present invention. Specifically, the acoustic device 100 is configured as a microphone speaker equipped with a speaker and microphones. Although not illustrated, the acoustic device 100 is placed on a table surface, etc., so as to be used as a sound input terminal or a sound output terminal for a remote conference system and the like.

Figure 3:
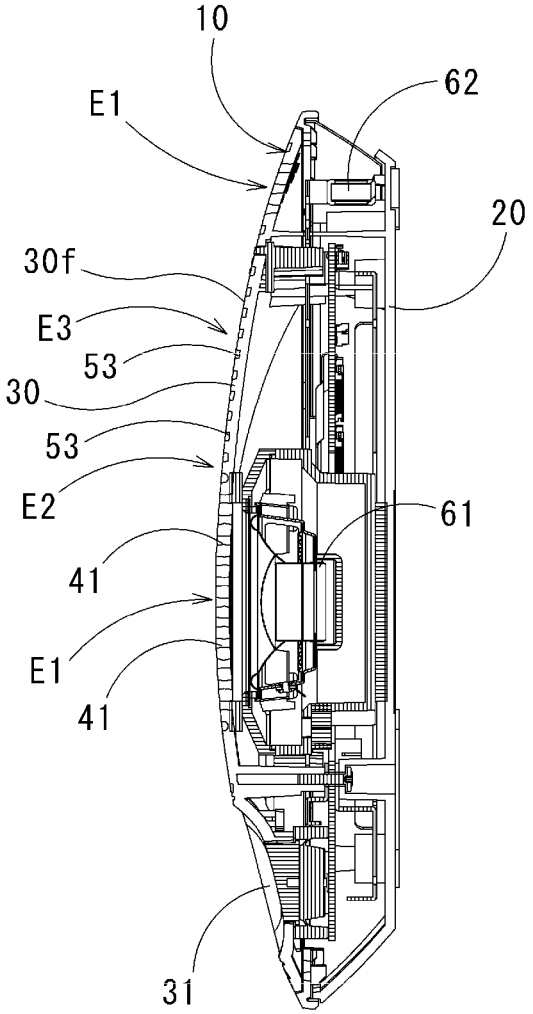
FIG. 3 is a cross sectional view along the line A-A in FIG. 2A.

As illustrated in FIG. 3, the acoustic device 100 is equipped with a speaker 61 and three microphones 62. As illustrated in FIG. 2A, the speaker 61 and the microphones 62 are accommodated in a housing 10, which is formed into a regular triangle as a whole in a planar view, with rounded apexes. The housing 10 is provided with a base 20 placed on a table surface, etc. and a grille 30 mounted so as to cover the base 20. The speaker 61 is provided at the central portion of the base 20. Each microphone 62 is provided in the corresponding one of the corner portions of the base 20, whereby the microphones 62 are arranged to surround the speaker 61. The microphones 62 enable collection of sound in three directions at 120° intervals with respect to the central portion in a planar view. Also, an exterior surface 30*f* of the grille 30 is formed in a gently-sloping convex surface having a downward slope from the central portion toward the corner portions.

Since the grille 30 is mounted to the base 20 so as to cover the front faces, etc. of the speaker 61 and the microphones 62 provided on the base 20, the speaker 61 and the microphones 62 are accommodated in the housing 10 between the base 20 and the grille 30. Accordingly, the speaker 61 and the microphones 62 are placed in a space surrounded by the base 20 and the grille 30. In the descriptions below, the upper-lower direction and the front-back direction are referred to as follows: the grille 30 provided on the base 20 as shown in FIG. 1 is disposed on an upper side or a front side; and the base 20 placed on a table surface, etc. as shown in FIG. 1 is disposed on a lower side or a back side.

Figure 4:
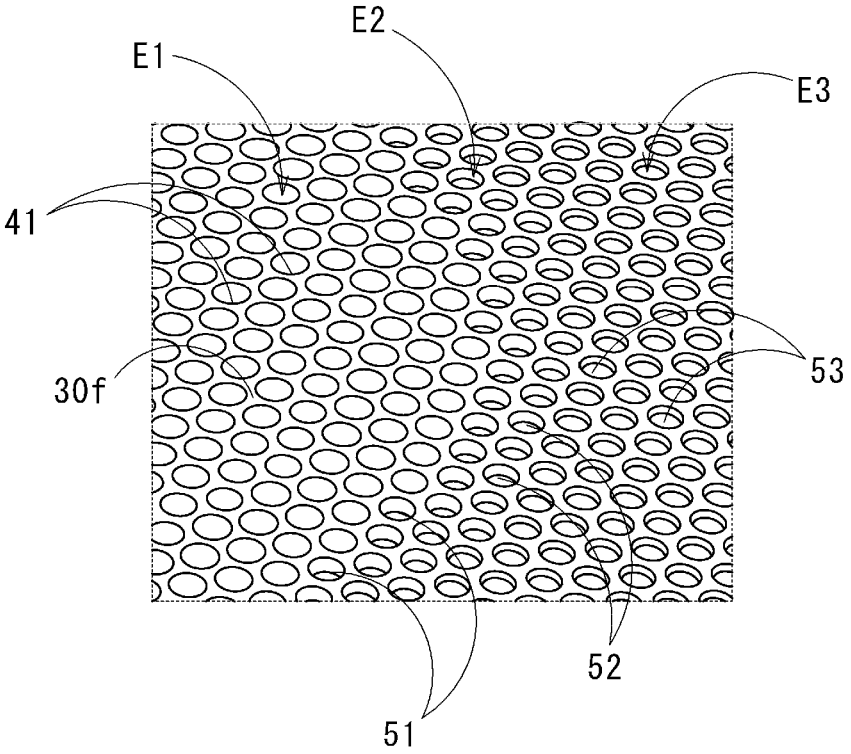
FIG. 4 shows an essential part of a central portion of the grille of FIG. 1.
Figure 5:
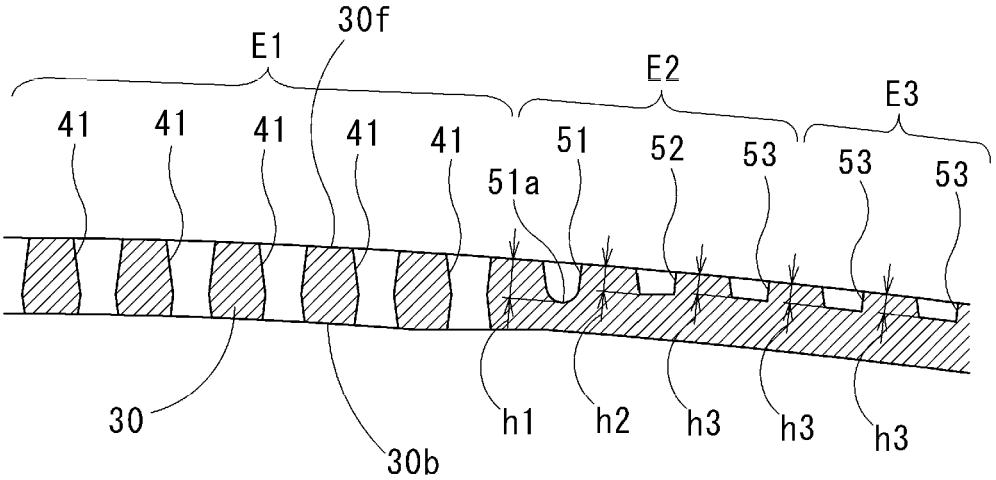
FIG. 5 shows a cross sectional view of the essential part of the central portion of the grille of FIG. 3.

The grille 30 is provided with a plurality of through hole-provided regions E1 (four regions in the present embodiment) in the positions where the speaker 61 and the microphones 62 are provided, i.e., on the front faces of the speaker 61 and the microphones 62, and the plurality of through hole-provided regions E1 have a plurality of through holes 41 which penetrate the grille 30 in the thickness direction for emission and collection of sound. Through the through holes 41, the speaker 61 provided in the housing 10 emits sounds to the outside and the microphones 62 therein collect sounds from the outside. Furthermore, as illustrated in FIG. 4 and FIG. 5, a non-through hole-provided region E2 is provided around the through hole-provided region E1 on the front face of the speaker 61. The non-through hole-provided region E2 is provided adjacent to the through hole-provided region E1 and has a plurality of non-through holes 51 to 53 each with a bottom which have openings each having the same diameter as that of each through hole 41. Therefore, the grille 30 comprises: the through hole-provided regions E1 having the plurality of through holes 41; and the non-through hole-provided regions E2 having the plurality of non-through holes 51 to 53 each with a bottom, and provided adjacent to the through hole-provided region E1. Furthermore, the non-through hole-provided region E2 is formed to surround the through hole-provided region E1. Therefore, the arrangement expressed by the wording "provided adjacent to" encompasses an arrangement expressed by the wording "formed to surround". Moreover, an exterior design region E3 is provided around the non-through hole-provided region E2. The exterior design region E3 is provided adjacent to the non-through hole-provided region E2 and has the plurality of non-through holes 53, each with a bottom and an opening, which has the same diameter as that of each through hole 41. In other words, the grille 30 includes: the non-through hole-provided region E2 provided to be continuous with one through hole-provided region E1 and to surround the through hole-provided region E1; and the exterior design region E3 provided to be continuous with the non-through hole-provided region E2 and to surround the non-through hole-provided region E2. Consequently, with the through holes 41 and the non-through holes 51 to 53, the plurality of openings are provided in a repetitive pattern almost over the entire surface of the exterior surface 30*f* of the grille 30 except for an operation unit 31. It is to be noted that "exterior design region" as referred to herein means a region that covers the base 20 except for the through hole-provided region and the non-through hole-provided region.

The opening of each of the through holes 41 and the non-through holes 51 to 53 is surrounded by six openings, and the openings are arranged at equal intervals. Therefore, the plurality of openings are arranged in a lattice pattern of regular triangles. As illustrated in FIG. 4 and FIG. 5, the non-through holes 51 to 53 in the non-through hole-provided region E2 are formed in such a manner that a depth h1 of the non-through hole 51 located on the inner side close to the through hole-provided region E1 is greater than a depth h3 of the non-through hole 53 located on the outer side distant from the through hole-provided region E1. Furthermore, a plurality of rows of the non-through holes 51 to 53 (three rows in the embodiment) are provided from the side adjacent to the through hole-provided region E1 toward the side distant therefrom, i.e., from the inner side to the outer side of the non-through hole-provided region E2, and as illustrated in FIG. 5, the depths h1 to h3 of the non-through holes 51 to 53 are set in such a manner that the depth of the non-through holes gradually decreases from the inner side toward the outer side. In other words, the depth h2 of the non-through holes 52 in a second row adjacent to a first row, which is the innermost row of the non-through holes 51 adjacent to the through holes 41, is set to be smaller (shallower) than the depth h1 of the non-through holes 51 in the first row. Similarly, the depth h3 of the non-through holes 53 in a third row adjacent the second row is set to be smaller than the depth h2 of the non-through holes 52 in the second row. Therefore, the depths h1 to h3 of the non-through holes 51 to 53 are set in such a manner that the depth of the non-through holes gradually decreases with increasing distance from the through hole-provided region E1.

The exterior design region E3 adjacent to the non-through hole-provided region E2 has the non-through holes 53 which are equivalent to the non-through holes 53 on the outermost side of the non-through hole-provided region E2 close to the exterior design region E3, i.e., the non-through holes 53 having the depth h3 equal to the depth h3 of the non-through holes 53 in the third row.

It is to be noted that, the exterior surface 30*f* of the grille 30 is formed into the shape of a convex surface having a downward slope from the through hole-provided region E1 in the central portion toward the exterior design region E3 in the corner portions, and thus the maximum depths from the exterior surface 30*f* to the bottoms of the non-through holes 51 to 53 in the thickness direction of the grille 30 are referred to as the reference depths for the depths h1 to h3 of the non-through holes 51. In the grille 30 illustrated in FIG. 5, for example, the depth h1 of the non-through holes 51 in the first row is 1.5 mm, the depth h2 of the non-through holes 52 in the second row is 1.2 mm, and the depth h3 of the non-through holes 53 in the third row and the subsequent rows is 1.0 mm.

The grille 30 having the aforementioned configuration is formed through injection molding by using a material having high rigidity, i.e., a synthetic resin such as a polycarbonate resin and an ABS resin, or the like. In the grill 30 of the present embodiment, as illustrated in FIG. 5, each through hole 41 is formed so as to decrease in diameter from the exterior surface 30*f* of the grille 30 toward the inside and to decrease in diameter from a lower face 30*b* on the opposite side toward the inside, with a constriction formed in the middle of the through hole 41. This shape is formed due to the use of mold release tapers as well as a joint provided inside the through hole 41 between an upper mold and a lower mold, in light of release performance upon molding. It is to be noted that the shape of the through holes 41 and the non-through holes 51 to 53 may be changed variously depending on the design and processing conditions, and thus is not limited to the shape according to the present embodiment. Similarly, the shape of the openings of the through holes 41 and the non-through holes 51 to 53 is not limited to the circular shape illustrated in FIG. 4, and may be changed depending on the design.

In addition, the through holes 41 and the non-through holes 51 to 53 may be formed through drilling.

In the grille 30 having the aforementioned configuration, as the depth of the non-through holes 51 to 53 increases, external light is more likely to fail to reach deep into the non-through holes 51 to 53 each with a bottom. Therefore, by making the non-through holes 51 to 53 deeper, the intensity of the external light reflected by the bottom is lowered, and in turn the brightness in the holes can be lowered. Since the grille 30 is provided with the non-through holes 51 to 53 having different depths in such a manner that the non-through holes 51 close to the through hole-provided region E1 are deeper and the non-through holes 52 and 53 distant from the through hole-provided region E1 are shallower, whereby the brightness in the non-through holes 51 close to the through hole-provided region E1 is set to be lower than the brightness in the non-through holes 52 and 53 distant from the through hole-provided region E1. Accordingly, the difference in brightness between the through holes 41 and the non-through holes 51 to 53 which is visually recognized on the exterior surface 30*f* of the grille 30 is reduced, thereby enabling the boundary between the through hole-provided region E1 and the non-through hole-provided region E2 to be blurred, leading to the formation of a superior exterior design. In other words, the brightness in the non-through holes 51 located close to the through hole-provided region E1 can approach the brightness in the through holes 41 by making the non-through holes 51 located on the side adjacent to the through hole-provided region E1 deeper than the non-through holes 52 and 53 located on the side distant from the through hole-provided region E1, whereby the boundary between the through hole-provided region E1 and the non-through hole-provided region E2 is blurred and a superior exterior design is provided accordingly.

Among the plurality of the non-through holes 51 to 53 provided in the grille 30, the depth h1 of the non-through holes 51 (the non-through holes 51 in the first row) adjacent to the through hole-provided region E1 is the greatest, and the non-through holes 52 and the non-through holes 53 are provided in such a manner that the depth of the non-through holes gradually decreases with increasing distance from the through hole-provided region E1. Therefore, the brightness in the non-through holes 51 located close to the through hole-provided region E1 can be lower than the brightness in the non-through holes 53 located distant from the through hole-provided region E1. In the non-thorough hole-provided region E2 that adjoins the through hole-provided region E1, the depths h1 to h3 of the non-through holes 51 to 53 are set such that the depth of the non-through holes gradually decreases from the side of the non-through hole-provided region E2 adjacent to the through hole-provided region E1 toward the side of the non-through hole-provided region E2 distant from the through hole-provided region E1, whereby the brightness gradation is formed on the exterior surface 30*f* of the grille 30 in such a manner that the brightness gradually increases with increasing distance from the through hole-provided region E1.

Furthermore, the exterior design region E3 having a plurality of the non-through holes 53 is provided adjacent to the non-through hole-provided region E2, and the non-through hole-provided region E2 connects between the through hole-provided region E1 and the exterior design region E3. Therefore, the openings of the through holes 41 and the non-through holes 51 to 53 are formed on the entire exterior surface 30*f* of the grille 30, and these openings enable a consistent exterior design to be provided. Moreover, the difference in brightness at the boundary portion between the through holes 41 and the non-through holes 51 to 53 which is visually recognized on the exterior surface 30*f* of the grille 30 is reduced, thereby enabling the boundary between the through hole-provided region E1 and the non-through hole-provided region E2 to be blurred. Therefore, a superior exterior design with a sense of uniformity in which the brightness varies continuously from the through hole-provided region E1 toward the exterior design region E3 is provided.

It is to be noted that the non-through holes 51 to 53 having different depths is not limited to being arranged regularly and equally from the circumferential portion of the through hole-provided region E1 or being arranged in such a manner that the depth varies from row to row, but may be adjusted in such a manner that the depth varies in every two rows, for example. Also, the area that forms the non-through hole-provided region may be changed freely, and thus is not limited to three rows constituting the non-through hole-provided region E2 as in the present embodiment. Furthermore, in the grille 30, it is preferred that only the through holes are formed (the non-through holes are not formed) in the through hole-provided region E1, and that only the non-through holes are formed (the through holes are not formed) in the non-through hole-provided region E2 and the exterior design region E3. However, the non-through holes may be formed in the through hole-provided region E1 and the through holes may be formed in the non-through hole-provided region E2 and the exterior design region E3.

In light of inhibiting the intensity of external light reflected by the bottoms of the non-through holes 51 to 53, the bottoms of the non-through holes 51 to 53 are preferably formed as irregular-reflection surfaces by performing emboss processing, forming small R-surfaces, and forming a cone shape, etc. In the present embodiment, for example, the bottom of the non-through hole 51 in the first row of the non-through hole-provided region E2 is formed as an R face 51*a*, and thus, as compared to the case of being formed as a flat face, the intensity of the external light that has been reflected by the bottoms of the non-through holes 51 and has escaped outside can be further lowered. Therefore, even when the grille 30 is thin and the depth of the non-through holes 51 to 53 are small, the difference in brightness between the through holes 41 and the non-through holes 51 to 53 is reduced due to the irregular-reflection surfaces provided at the bottom. Furthermore, the difference in brightness in the non-through holes 51 to 53 can be adjusted more precisely by changing the shape of the bottoms of the non-through holes 51 to 53 in accordance with the depth parameter of the non-through holes 51 to 53, thereby enabling the design to be further improved. This leads to the formation of the acoustic device 100 having a superior exterior design.

Furthermore, as in the grille 30 according to the present embodiment, the non-through hole-provided region E2 having the non-through holes 51 to 53 each with a bottom is provided adjacent to the through hole-provided region E1, thereby enabling the strength of the grille 30 to be further improved, as compared to the case in which the through holes 41 are provided over the entire region of the exterior surface 30*f* of the grille 30.

Moreover, in the grille 30 according to the present embodiment, the through hole-provided region E1 is formed to precisely coincide with the aperture of the unit of the speaker or the microphone while the boundary between the through hole-provided region E1 and the non-through hole-provided region E2 is blurred, whereby the aperture of the unit of the speaker or the microphone is made appear larger than it really is.

It is to be noted that, in a conventional grille without the non-through hole-provided region described herein, such as the speaker grille disclosed in Patent Document 1, if a through hole-provided region was formed to be larger than the aperture of the unit of the speaker so as to make the aperture of the unit appear larger than it really is, a sound in opposite phase would be likely to enter the unit from the through holes located on the outer side of the aperture of the unit, often resulting in deterioration in efficiency of the speaker. Furthermore, due to such a larger through hole-provided region, dust, etc. may easily enter the housing and/or the strength of the grille may be degraded.

On the contrary, according to the grille 30 of the present embodiment, the non-through hole-provided region E2 is provided while the through hole-provided region E1 is provided so as to coincide with the aperture of the unit of the speaker or the microphone, whereby the aperture of the unit of the speaker 61 is made appear larger than it really is, and also prevention of entry of a sound in opposite phase and entry of dust, etc., into the housing 10 is enabled.

The present invention is not limited to the embodiment described above, and may be modified variously within the range not to depart from the spirit of the present invention.

For example, in the embodiment described above, by providing the plurality of non-through holes 53 in the exterior design region E3 of the grille 30, the exterior surface 30*f* is designed so that the openings are formed in a repetitive pattern from the through hole-provided region E1 toward the exterior design region E3. However, the exterior surface 30*f* may be formed to have another design without providing non-through holes in the exterior design region E3. Furthermore, the grille according to the present invention may be formed as a structure without an exterior design region.

The bottoms of the non-through holes 51 to 53 may not be formed as irregular-reflection surfaces. According to the grille 30 of the present invention, even when the bottoms of the non-through holes 51 to 53 are not formed as irregular-reflection surfaces, the formation of the grille having a superior exterior design is enabled by adjusting the depths of the non-through holes 51 to 53.

Furthermore, in the embodiment described above, the through hole-provided region E1 and the non-through hole-provided region E2 are provided to be adjacent to each other, and the non-through hole-provided region E2 surrounds the through hole-provided region E1. The through hole-provided region E1 and the non-through hole-provided region E2 may be provided to be adjacent to each other without the non-through hole-provided region E2 surrounding the through hole-provided region E1. In such a case, the depths of the non-through holes provided in the non-through hole-provided region E2 are adjusted in such a manner that the depth of the non-through holes located closest to the through hole-provided region E1 is the greatest and that the depth of the non-through holes decreases with increasing distance from the through hole-provided region E1.

Furthermore, the embodiment above has described the example in which the grille according to the present invention is employed as a grille for an acoustic device dealing with sound energy. Moreover, since the grille according to the present invention is capable of allowing air to move through the through holes, it may also be applied to electronic instruments for various uses other than the acoustic device, for example, a personal computer, instruments dealing with thermal energy such as an air conditioner, and an intake and exhaust grille for air holes (through holes) formed in furniture, etc.

EXPLANATION OF THE REFERENCE SYMBOLS

10 housing
20 base
30 grille
30*b* lower face
30*f* exterior surface
41 through hole
51 to 53 non-through hole
51*a* R face
61 speaker
62 microphone
100 acoustic device
E1 through hole-provided region
E2 non-through hole-provided region
E3 exterior design region

The invention claimed is:

1. A grille comprising:

a plurality of through hole-provided regions each having a plurality of through holes; and a non-through hole-provided region having a plurality of non-through holes each with a bottom, and provided adjacent to and surrounding each of the plurality of through hole-provided regions, wherein the through holes and the non-through holes entirely provide a plurality of openings on an exterior surface of the grille, and in the non-through hole-provided region, a depth of the non-through holes disposed close to the plurality of through hole-provided regions is greater than a depth of the non-through holes disposed distant from the plurality of through hole-provided regions.

2. The grille according to claim 1, wherein in the non-through hole-provided region, a plurality of rows of the non-through holes are formed from a side adjacent to at least one through hole-provided region of the plurality of through hole-provided regions toward a side distant from the at least one through hole-provided region.

3. The grille according to claim 2, wherein the rows are formed in such a manner that the depth of the non-through holes gradually decreases from the side adjacent to the at least one through hole-provided region toward the side distant from the at least one through hole-provided region.

4. The grille according to claim 1, wherein the bottoms of the non-through holes have irregular-reflection surfaces.

5. The grille according to claim 4, wherein the irregular-reflection surfaces include embossed surfaces, small R-surfaces, or cone-shaped surfaces.

6. The grille according to claim 1, wherein an exterior design region is provided adjacent to the non-through hole-provided region on the exterior surface.

7. The grille according to claim 6, wherein the exterior design region surrounds the non-through hole-provided region.

8. The grille according to claim 6, wherein, in the exterior design region, a plurality of non-through holes are provided which have the same depth as that of the non-through holes in the non-through hole-provided region on a side close to the exterior design region.

9. The grille according to claim 1, wherein in the non-through hole-provided region, a plurality of rows of the non-through holes are formed from a side adjacent to at least one through hole-provided region of the plurality of through hole-provided regions toward a side distant from the at least one through hole-provided region, the rows are formed in such a manner that the depth of the non-through holes gradually decreases from the side adjacent to the at least one through hole-provided region toward the side distant from the at least one through hole-provided region, and the grille is provided in such a manner that the thickness of the grille from the bottoms of the non-through holes gradually increases from the side adjacent to the at least one through hole-provided region toward the side distant from the at least one through hole-provided region.

* * * * *